US005508485A

United States Patent [19]

Nishikawa

[11] Patent Number: 5,508,485

[45] Date of Patent: Apr. 16, 1996

[54] PUSHBUTTON SWITCH

[75] Inventor: Kikuyoshi Nishikawa, Yokohama, Japan

[73] Assignee: Sagami Electri Co., Ltd., Kanagawa, Japan

[21] Appl. No.: 373,784

[22] Filed: Jan. 17, 1995

[30] Foreign Application Priority Data

Jan. 21, 1994 [JP] Japan ..... 6-005390

[51] Int. Cl.[6] ..... H01H 13/42

[52] U.S. Cl. ..... 200/525; 200/523; 200/529

[58] Field of Search ..... 200/520, 523, 200/525, 529, 534, 535, 537, 341

[56] References Cited

U.S. PATENT DOCUMENTS

| | | | |
|---|---|---|---|
| 3,183,333 | 5/1965 | Golbeck | 200/525 |
| 4,204,102 | 5/1980 | Bull | 200/525 |
| 4,357,511 | 11/1982 | Tenner et al. | 200/525 |

*Primary Examiner*—David J. Walczak

*Attorney, Agent, or Firm*—Pollock, Vande Sande & Priddy

[57] ABSTRACT

A pushbutton switch is provided comprising a pushbutton having its lower portion inserted in a pushbutton housing section and being formed in its lower end with a pin accommodating hole; a pin having its upper end portion resiliently held in the pin accommodating hole by a coil spring; and a movable contact support having a movable contact piece therein and held in a switch housing section for seesaw motions by the lower end of the pin, whereby electric connection of the common contact is switched between two fixed contacts. A spring retainer plate to which the lower end of the coil spring is fixed is housed in the switch housing section for vertically upward and downward sliding movements. The spring retainer plate is formed at its opposite ends with legs depending therefrom for always maintaining the posture of the spring retainer plate parallel to the bottom panel. A switching member is interposed between the undersurface of the spring retainer plate and the top surface of the movable contact support so as to transmit the resilient force of the coil spring from the spring retainer plate to the movable contact support through the switching member to thereby hold the tilt of the movable contact support in a "bistable" manner.

11 Claims, 12 Drawing Sheets

PUSHBUTTON SWITCH

FIELD OF THE INVENTION

This invention relates to a pushbutton switch of the alternate type suitable for use with various electronic devices and the like.

BACKGROUND OF THE INVENTION

The conventional pushbutton switch of the alternate type, commonly called a "push switch", as described as prior art in U.S. Pat. No. 4,740,661 issued to the same assignee as the present application, was troublesome in assembling because of its complicated construction wherein an actuator pin is actuated by a pushbutton to pivotally drive a switching member having a pushrod outwardly biased by a spring, which pushrod in turn pivotally drives a movable contact support carrying a movable contact piece to thereby selectively bring a common contact connected to the movable contact piece into electric contact with either one of two fixed contacts.

In addition, the pushbutton switch had the disadvantage of low reliability in operation because of contact failure tending to occur due to dust sticking to the contacts through a long period of time as the movable contact piece and fixed contacts are brought into contact with each other always at the same portions.

In an attempt to solve the foregoing problems, the present applicant proposed an improved pushbutton switch of the alternate type in Japanese Utility Model Application No. 32642/1992 (4-32642) filed May 19, 1992. This earlier proposed pushbutton switch is illustrated in FIG. 1 as a vertical cross-sectional view and in FIG. 2 as a ninety degree turned cross-sectional view taken on line II—II of FIG. 1.

This switch comprises an insulating case 13 having a bottom opening closed by a bottom panel 14 through which contacts 15, 16 and 17 extend out as terminals. Mounted on the bottom panel 14 is a movable contact support 19 for seesaw motions with the lower end of a projection extending from the bottom surface of the support 19 at the center thereof as a fulcrum. Movable contact pieces 18 bent in the shape of an inverted U are retained in corresponding accommodating grooves 19S formed in the bottom surface of the support 19. The seesawing movement of the movable contact support 19 causes the movable contact pieces 18 in unison with the support 19 to pivot in resilient contact with the common contacts 15 extending inwardly from the bottom panel 14 whereby the opposite ends of the movable contact pieces 18 are slidingly moved into and out of the corresponding fixed contacts 16 and 17.

The movable contact support 19 has a mountain-like transverse ridge or crest raised from its top surface with an apex lying in the center of the surface such that the oppositely downwardly sloping surfaces 19A and 19B of the ridge define slide guide paths for the tip of a pin 21. Extending from the lowermost ends of the respective inclined surfaces 19A and 19B toward the opposite ends of the support 19 are upwardly sloping surfaces 19AA and 19BB which define abutment surfaces. The movable contact support 19 has transverse recesses 19R formed in the opposed side walls 19W (see FIG. 2) centrally of the length between which the inclined surfaces 19A and 19B transversely extend.

Resting on the movable contact support 19 is a spring retainer plate 22 having opposed spaced apart triangular plate-like supporting projections 22T protruding from the undersurface thereof, the projections 22T in being engagement with the corresponding recesses 19R of movable contact support 19 to permit the seesaw motion of the spring retainer plate 22.

The pin 21 passes through a slot 22A formed through the spring retainer plate 22 and has a flange 21A formed at an upper end thereof. The flange 21A is engaged by the upper end of a frusto-conical coil spring 23 and resiliently urged thereby against the bottom wall (the most recessed portion) of a pin receiving hole 12A formed in the lower end surface of a pushbutton 12 which is in turn mounted in a pushbutton housing section 11 of the insulating case 13. The lower end of the coil spring 23 is securedly supported by the top surface of the spring retainer plate 22.

With the pushbutton 12 in its outermost position, the lower end of the pin 21 is in spaced and opposed relation to either one of the inclined surfaces 19A and 19B, the surface 19B, for instance. As the pushbutton 12 is depressed, the lower end of the pin 21 is brought into contact with and slides down the one inclined surface 19B until it abuts against the abutment surface 19BB to turn the movable contact support 19 into the oppositely tilted orientation while at the same time inverting the tilted orientation of the spring retainer plate 22, with the result that the contacts of the movable contact pieces 18 with the fixed contacts 16 and 15 are inverted.

Upon the pushbutton 12 being released, the pushbutton 12 and pin 21 are restored by the coil spring 23 into their initial positions while the tilted orientation of the movable contact support 19 is maintained as it is by the spring retainer plate 22, so that the lower end of the pin 21 is in spaced and opposed relation to the other inclined surfaces 19A.

In the illustrated example, since the spring retainer plate 22 is constructed so as to be freely swingable, it not only supports the lower end of the spring 23 on the top surface thereof but also acts as a switching member which can change over the direction of the seesaw motion of the movable contact support 19.

With this construction, each time the pushbutton 12 is pushed down, the pin 21 is brought into direct contact alternately with the inclined surfaces 19A and 19B of the movable contact support 19 which guide the tip end of the pin 21 toward either of the abutment surfaces 19AA or 19BB of the movable contact support 19 adjacent the opposite ends thereof, whereby downward force is applied alternately to the ends of the movable contact support 19 to seesaw the movable contact support 19 and hence the movable contact pieces 18. The seesaw motion of the movable contact pieces 18 brings the common contacts 15 into electric connection alternately with the fixed contacts 16 and 15, thus effecting the alternate operation.

The earlier proposed pushbutton switch as described above is characterized in that the arrangement in which the spring retainer plate 22 is acted on by the spring 23 so as to hold the movable contact support 19 in its stable state in either one of the two tilted positions is independent of the arrangement in which the movable contact support 19 is actuated by the lower end of the pin 21.

It is to be noted that the spring retainer plate 22 is arranged to be freely swingable and that the biasing force of the resilient spring 23 is transmitted to the movable contact support 19 by means of the freely swingable spring retainer plate 22 to impart the downward force (force directed toward the bottom panel 14) to the seesawing movable contact support 19. This downwardly directed force ensures the "bistable" seesawing motion of the movable contact piece 18.

In addition, the construction of the movable contact piece 18 described in the Japanese Utility Model Application No. 32642/1992 ensures that the movable contact piece 18 slidingly moves relative to the fixed contacts 16, 17 to effect what is called "self-cleaning action" as it is moved into and out of contact with the fixed contacts. This movable contact piece thus provides the advantage that it prevents contact failure from occurring for a long time of use, thereby enhancing the reliability of the contacts.

In assembling the earlier proposed pushbutton switch, the pushbutton 12, pin 21, coil spring 23 and spring retainer plate or switching member 22 are successively (in the order named) inserted into the insulating case 13 with the bottom opening thereof facing upward, then the movable contact support 19 with the movable contact pieces 18 supported therein is inserted into the case, and finally the bottom opening is closed by the bottom panel 14 to complete the assembly.

It has been found, however, that the spring retainer plate 22 cannot sometimes be assembled in proper position relative to the coil spring 23, since the spring retainer plate 22 is not positively anchored in position so as to be free to swing in the insulating case 13. For this reason, the time required for the assembly tends to be undesirably prolonged.

SUMMARY OF THE INVENTION

Accordingly, it is an object of this invention to provide an improved pushbutton switch which is easy to assemble. According to the teachings of this invention, a pushbutton switch is provided comprising an insulating case including a pushbutton housing section and an integral switch housing section having a bottom opening closed by a bottom panel, a pushbutton having its lower portion inserted in the pushbutton housing section and being formed in its lower end with a pin accommodating hole, a pin having an upper end portion resiliently held in the pin accommodating hole by a coil spring, and a movable contact support having a movable contact piece therein and held in the switch housing section for seesaw motions by the lower end of the pin, whereby electric connection of a common contact is switched between two fixed contacts, wherein a spring retainer plate to which the lower end of the coil spring is fixed is housed in the switch housing section for vertically upward and downward sliding movements, the spring retainer plate being formed at its opposite ends thereof with legs depending therefrom for always maintaining the posture of the spring retainer plate parallel to the bottom panel. A switching member may be interposed between the undersurface of the spring retainer plate and the top surface of the movable contact support so as to transmit the resilient force of the coil spring from the spring retainer plate to the movable contact support through the switching member to thereby hold the tilt of the movable contact support in a "bistable" manner.

With this construction, the spring retainer plate may be confined to only the vertically upward and downward movements to always maintain the posture parallel to the bottom panel. Accordingly, during the assembly the spring retainer plate may be assembled in the insulating case in a fixed position to ensure reproducibly accurate assembly and the labor involved in the assembling operation is greatly reduced.

DETAILED DESCRIPTION OF THE PREFERRED EMBODIMENTS

Figure 1:
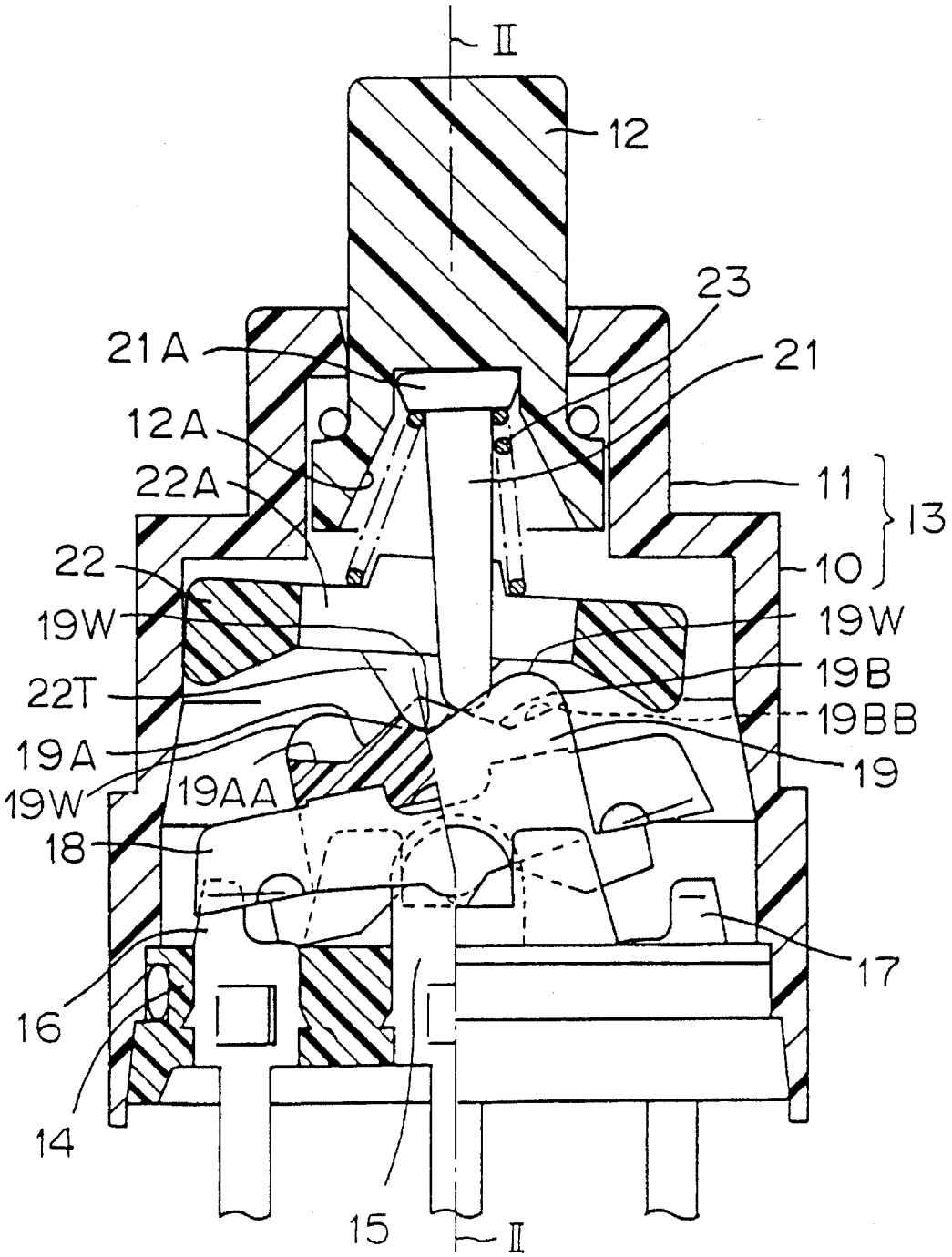
FIG. 1 PRIOR ART
FIG. 1 is a vertical cross-sectional view illustrating a prior art pushbutton switch.
Figure 2:
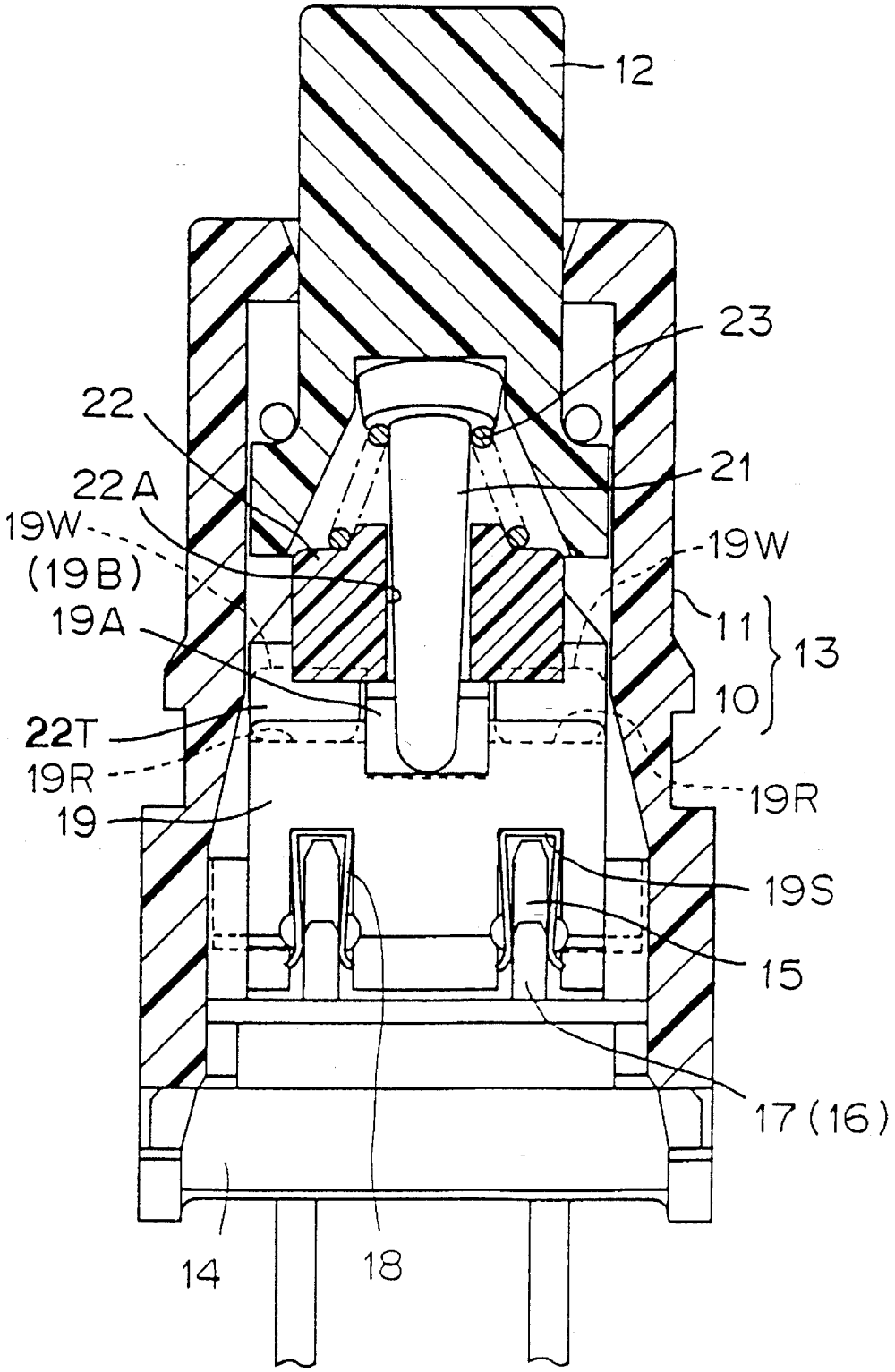
FIG. 2 PRIOR ART
FIG. 2 is a vertical cross-sectional view taken on line II—II of FIG. 1.

FIGS. 3 to 10 illustrate the construction of a first embodiment of the pushbutton switch according to this invention in which like reference numerals are used for those components which correspond to components of the prior art pushbutton switch shown in FIGS. 1 and 2.

As described hereinabove with respect to the prior art, the insulating case 13 is formed of resinous material and comprises a box-like switch housing section 10 and an integral cylindrical pushbutton housing section 11 extending upwardly from the section 10, the two sections defining a common interior space therein. The pushbutton housing section 11 has an inner diameter smaller than the inside dimensions of the switch housing section 10.

The pushbutton 12 has a pin receiving hole 12A formed in its lower end surface at a central portion thereof for accommodating a pin 21 and a frusto-conical coil spring 23. The pushbutton 12 is upwardly urged by the resilient force of the spring 23 while a pin 21 is also upwardly urged by the spring 23 pressing on a flange 21A formed at the upper end of the pin 21 so that the pin is supported so as to be freely swingable.

According to this invention, a spring retainer plate 22 made of insulating material for securedly supporting the lower end of the spring 23 is accommodated in the switch housing section 10 for slidable movements along the inner wall of the housing section. The spring retainer plate 22 has a pair of integral legs 22B at its opposite ends extending toward the bottom panel 14 and adapted to slide along the the inner wall of the switch housing section 10 so as to maintain the posture of the spring retainer plate 22 parallel to the bottom panel 14.

Figure 5:
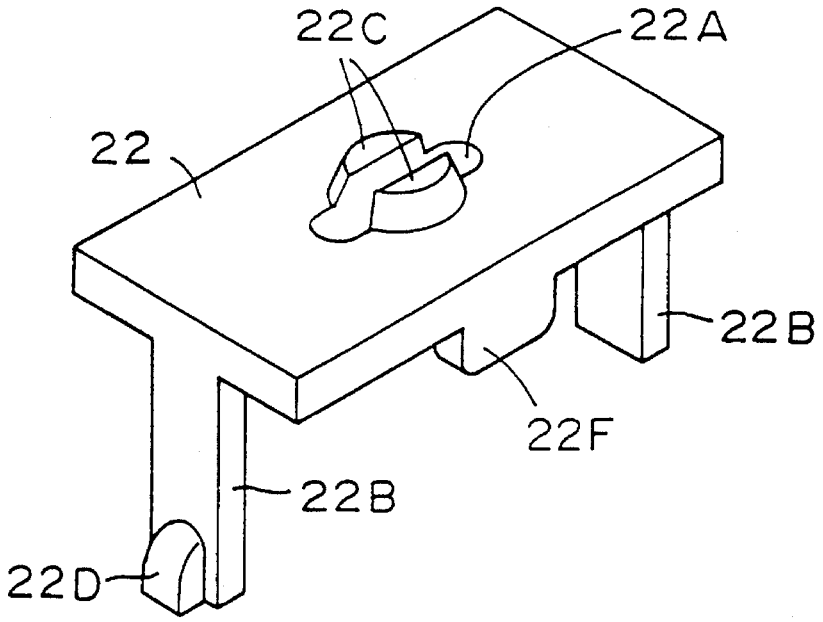
FIG. 5 is a perspective view illustrating the construction of the spring retainer plate 22 used in the embodiment of FIG. 3.
Figure 6:
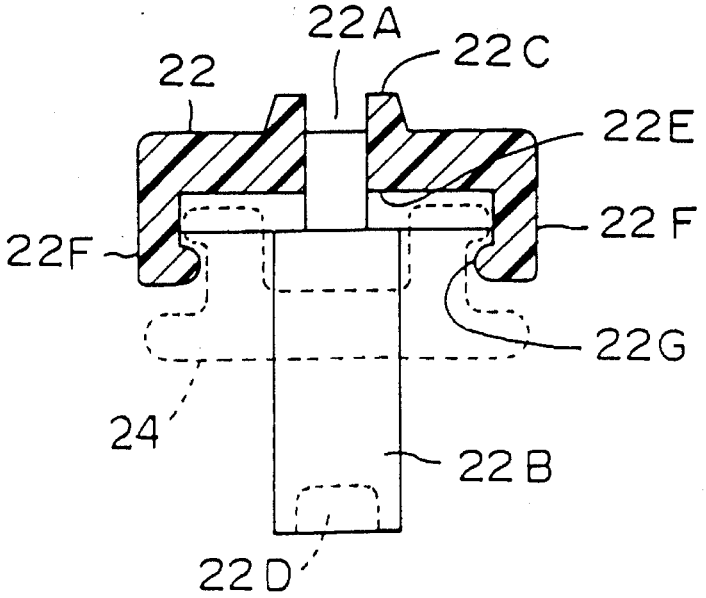
FIG. 6 is a cross-sectional view showing the details of the spring retainer plate 22.

FIGS. 5 and 6 show the detailed construction of the spring retainer plate 22. The rectangular spring retainer plate 22 has a slot 22A extending therethrough generally centrally thereof through which the pin 21 is passed longitudinally. Extending from the top surface of the spring retainer plate 22 are a pair of opposed bosses 22C on the opposite sides of the slot 22A. The bosses 22C are adapted to engage the lower end of the spring 23 to prevent the spring from slipping out of place. The legs 22B are formed on their outer surfaces adjacent their lower ends with lateral protuberances 22D which are adapted to be urged against the inner wall of the switch housing section 10 by the resilience of the legs 22B whereby the spring retainer plate 22 is prevented from being dislodged from the housing section 10 by the resilient force of the spring 23 when the spring retainer plate 22 is being inserted into the switch housing section 10 with the pushbutton 12 in its uppermost position where the pressure of the pushbutton exerted on the spring 23 is minimal.

As shown in FIG. 6, the undersurface of the spring retainer plate 22 is formed with a V-shaped groove 22E extending transversely of the slot 22A add a pair of opposed depending tabs 22F at the opposite ends of the V-shaped groove 22E. The tabs 22F are formed on their inner surfaces adjacent their lower ends with protrusions 22G extending toward each other and in parallelism to the the undersurface of the spring retainer plate 22.

Figure 7:
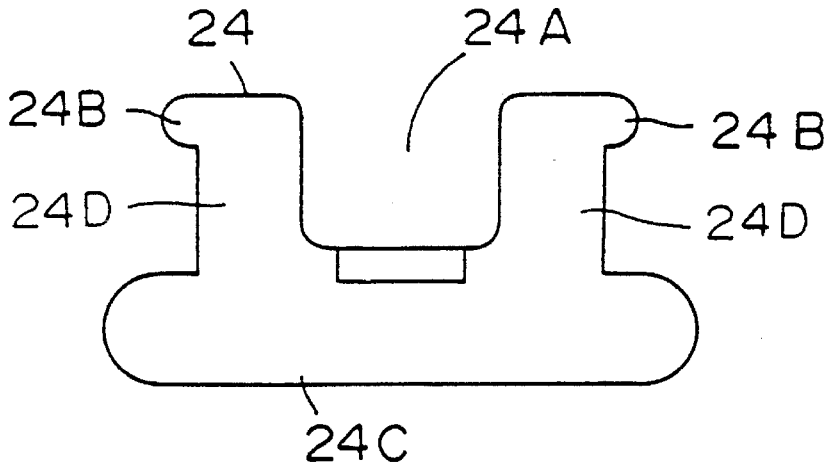
FIG. 7 is a front view illustrating the construction of the switching member 24 used in the embodiment of FIG. 3.

A switching member 24 is mounted to the spring retainer plate 22. As shown in FIG. 7, the switching member 24 comprises an elongated bar 24C and a pair of arms 24D extending perpendicularly from the bar adjacent its opposite ends and defining a recess 24A therebetween. The arms 24D have protrusions 24B extending away from each other outwardly from the top ends thereof. The top ends of the arms 24D are adapted to engage in the V-groove 22E of the spring retainer plate 22 with the protrusions 24B interlocking with the protrusions 22G of the spring retainer plate 22 such that the switching member 24 is pivotable about a longitudinal axis extending through the V-groove 22E beneath the spring retainer plate 22. It is thus to be appreciated that since it is possible to have the switching member 24 mounted in advance to the spring retainer plate 22, the assembly of the pushbutton switch is significantly facilitated. The range of swing may be limited to a minimum by selecting the opening angle of the V-groove 22E at a predetermined value, whereby it is easier to align the groove or seat 19C of a movable contact support 19 as will be described with the bottom of the switching member 24.

Figure 8:
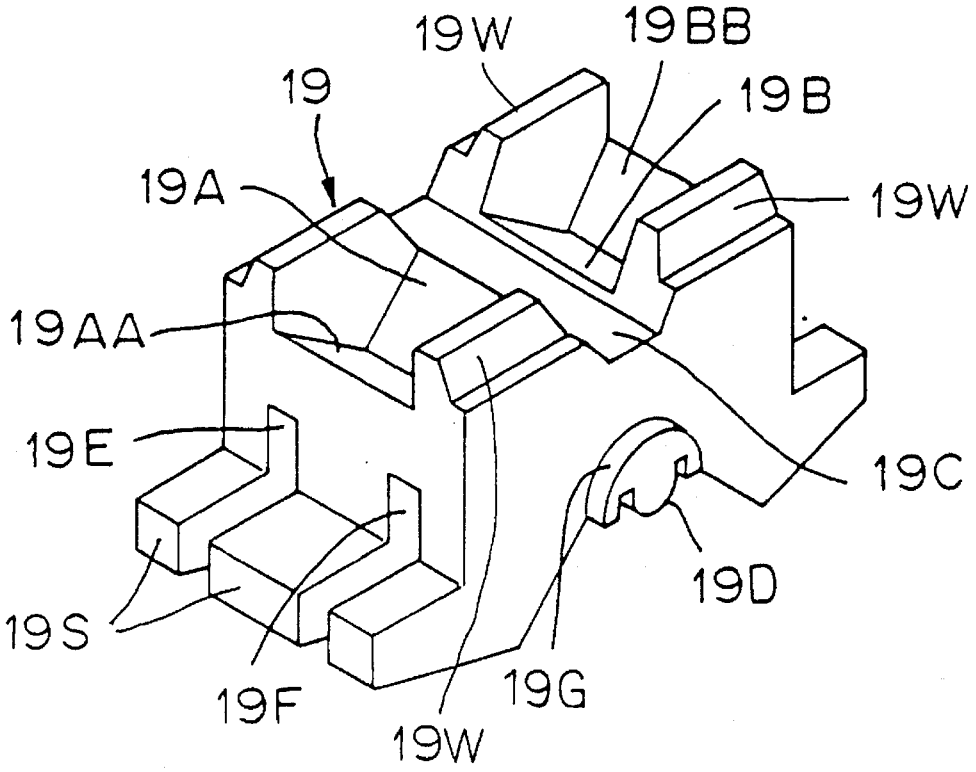
FIG. 8 is a perspective view illustrating the construction of the movable contact support 19 used in the embodiment of FIG. 3.

As illustrated in FIG. 8, the movable contact support 19 is formed of insulating material in the form of a block having two opposite end faces and two side faces perpendicular to the end faces. The end faces have ledges 19S extending therefrom adjacent the bottom thereof. The side faces have short stubs 19G extending therefrom adjacent the bottom at the center thereof to define an axis about which the movable contact support 19 pivots. The bottom surface of the support 19 is formed with two parallel grooves extending through the ledges 19S for accommodating respective movable contact pieces 18.

On its top surface the movable contact support 19 has inclined surfaces 19A and 19B converging to define a central ridge having a peak extending perpendicularly to the grooves 19E, 19F, and abutment surfaces 19AA and 19BB joining the respective inclined surfaces 19A and 19B but oppositely sloping and cooperating therewith to define V-valleys. The configuration of the movable contact support 19 described so far is generally similar to that of the conventional support shown in FIGS. 1 and 2.

According to this invention, the movable contact support 19 is formed with opposed side walls 19W extending upwardly beyond the peak of the ridge at the opposite ends of the V-valleys along the length thereof, the seat 19C extending through the opposed side walls 19W as well as the peak of the ridge.

The lower edge of the bar 24C of the switching member 24 is engaged with the groove 19C formed in the top of the movable contact support 19 (see FIG. 8) parallel to the axis of rotation thereof, whereby the resilient force of the spring exerted through the spring retainer plate 22 and the switching member 24 is transmitted to the fulcrum 19D of the movable contact support 19 and either one of the fixed contacts 16 or 17 against which the contact support 19 has tilted. The pin 21 is guided in its sliding movement by the oppositely sloping surfaces 19A and 19B on the opposite sides of the groove 19C so as to seesaw the movable contact support 19 each time the pushbutton 12 is pushed down.

Figure 9:
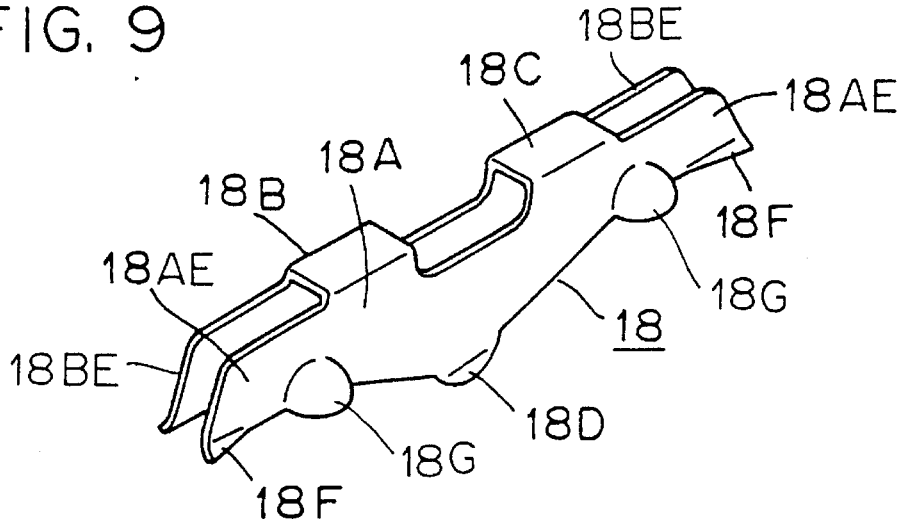
FIG. 9 is a perspective view illustrating the construction of the movable contact piece 18 used in the embodiment of FIG. 3.

Movable contact pieces 18 as shown in FIG. 9 are mounted in the respective grooves 19E and 19F formed in the bottom of the movable contact support 19. Each of the movable contact pieces 18 is made of a resilient metal sheet generally in the form of an inverted U in cross-section and has a pair of spaced opposed elongated contact blades 18A and 18B, and web portions 18C interconnecting the contact blades at their upper edges intermediate their opposite ends. The contact blades 18A and 18B have common contact portions 18D depending downwardly therefrom at the center of their lower edges for resiliently pinching the common contact 15 (FIG. 10) therebetween. The contact blades 18A, 18B have opposite end portions 18AE and 18BE separated from each other and referred to as "free end portions." The free end portions 18AE, 18BE have lower edge portions bent outwardly away from each other to define guides 18F for guiding the corresponding fixed guides 16 and 17 into pinched engagement between the free end portions 18AE and 18BE.

Figure 10:
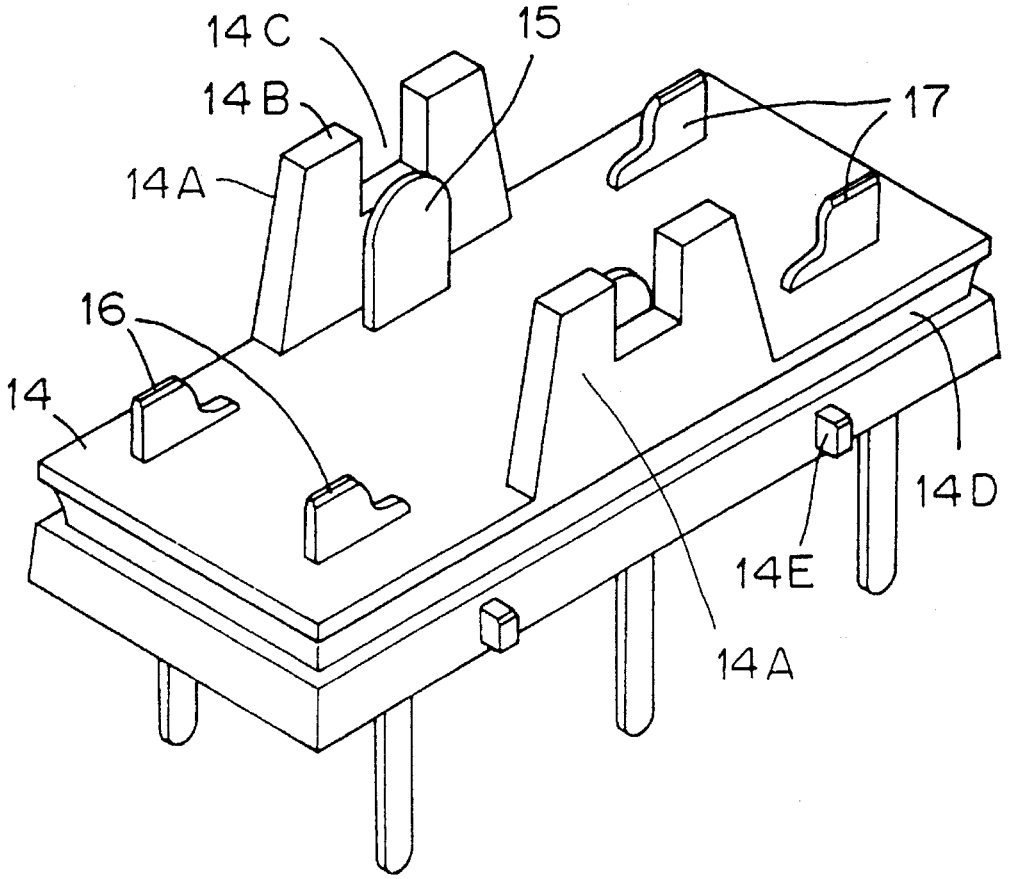
FIG. 10 is a perspective view illustrating the construction of the bottom panel 14 used in the embodiment of FIG. 3.

The central portions of the two movable contact pieces 18 are nested in the respective grooves 19E and 19F of the movable contact support 19 and the free end portions 18AE and 18BE extend beyond the outer ends of the ledges 19S of the support 19 with the lower edges of the free end portions lying at the same level as the top surfaces of the ledges. The movable contact pieces 18 are held in the grooves 19E and 19F by protuberances 18G extending outwardly from the free end portions 18AE, 18BE adjacent the lower edges of their root portions engaging with the top surfaces of the ledges 19S. As shown in FIG. 10, the rectangular bottom panel 14 has a pair of opposed generally trapezoidal bearing lugs 14A extending from the top surface thereof at the center of their major sides. The bearing lugs 14A are formed in their top ends 14B with bearing recesses 14C for receiving the semi-circular stubs 19G (FIG. 6) of the movable contact support 19 with the fulcrums 19D resting on the bottoms of the recesses 14C for permitting seesaw motions of the support 19. The bottom panel 14 is formed around its outer peripheral sides with a groove 14D. The pushbutton switch is mounted to a printed circuit board, and the groove 14D serves to prevent ingress of flux into the switch housing section 10 when the pushbutton switch is temporarily secured to the printed circuit board and immersed in a solder bath to solder it to the board. The bottom panel 14 further has projections 14E extending from its outer peripheral sides which are adapted to be received in corresponding holes formed in the walls of the insulating case 13 to prevent dislodgement of the bottom panel. With the construction described above, in the position shown in FIG. 4 where the pushbutton switch is not depressed, the pin 21 is at rest in the recess 24A of the switching member 24 with the axis of the pin 21 being at a stable position directed to intersect with the pivotal axis of the movable contact support 19 as shown in phantom lines in FIG. 3. In this position, the tip end of the pin 21 is in spaced opposed relation with either one of the inclined surfaces 19A, 19B on the side where the corresponding free end of the movable contact piece 18 is out of contact with the corresponding fixed contact. Let it now be assumed that the movable contact piece 18 and movable contact support 19 are in their tilted position with their right ends raised as opposed to the position shown in solid lines in FIG. 3. When the pushbutton 12 is pressed down, the tip end of the pin 21 comes into engagement with the inclined surface 19B and slides down the surface to the right until it abuts against the abutment surface 19BB extending generally orthogonally to the inclined surface to exert downward pressure on the abutment surface, whereupon an actuating force in a clockwise direction is applied to the movable contact support 19 to turn it clockwise about the fulcrum 19D. During this pivoting movement, when the movable contact support 19 goes through its horizontal posture, the switching member 24 assumes the upright position whereupon the spring retainer plate 22 is moved to its uppermost position. Upon any further movement from this horizontal position toward the right end lowered position, the movable contact support 19 is quickly pivoted in a clockwise direction under the biasing force of the spring 23 exerted through the switching member 24 until the rightmost end of the movable contact support 19 abuts with the top surface of the bottom panel 14 as illustrated in solid lines in FIG. 3. At this point, the movable contact piece 18 comes into contact with the fixed contact 17 with the free end portions 18AE and 18BE pinching the fixed contact therebetween to thereby switch the common contact 15 into electric contact with the fixed contact 17.

Figure 3:
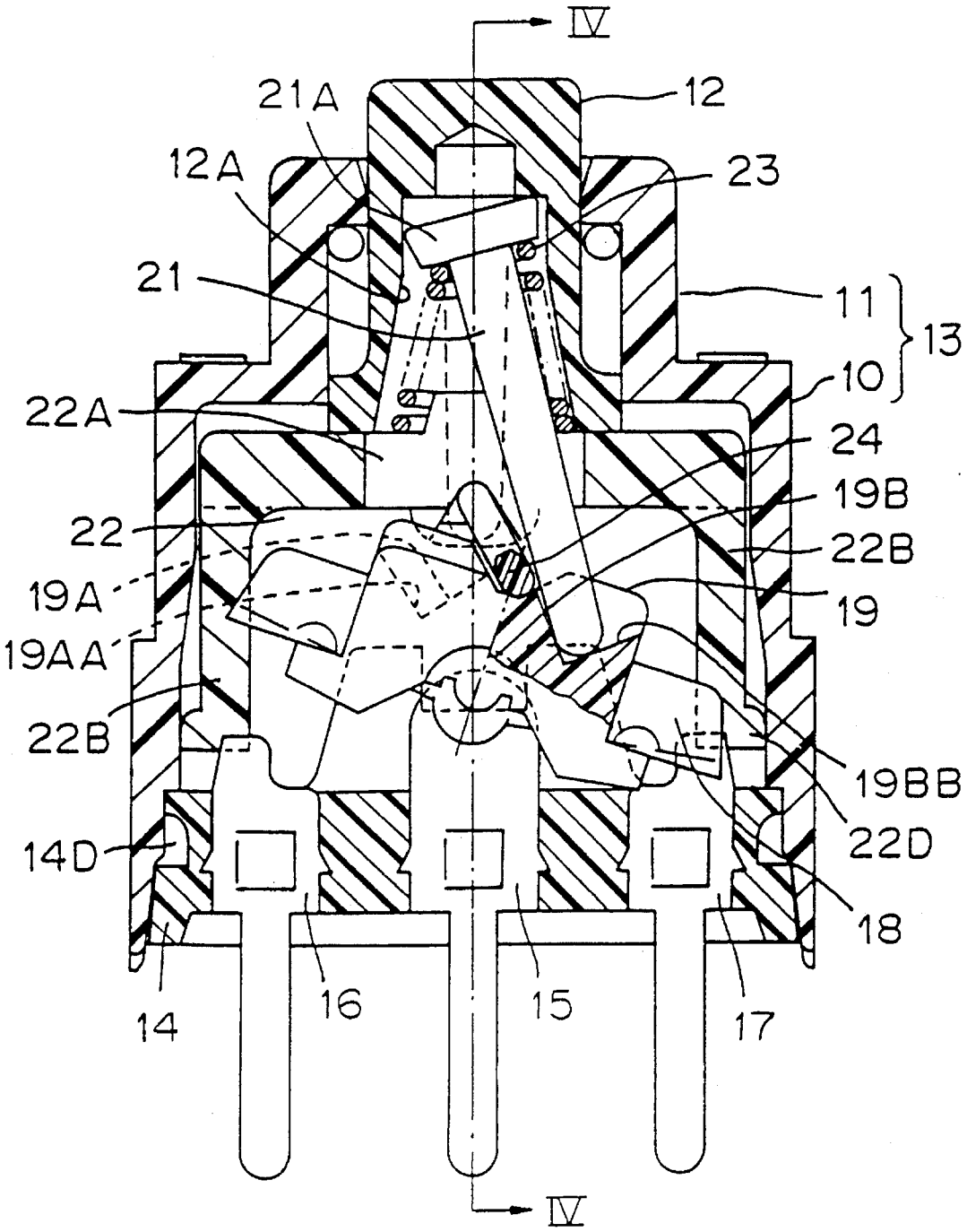
FIG. 3 is a vertical cross-sectional view of the pushbutton switch according to one embodiment of this invention showing the pushbutton 12-being depressed.

Upon releasing the downward operating force on the pushbutton 12 in the position shown in FIG. 3, the pushbutton 12 is restored to its upper position under the resilient force of the spring 23. The tip end of the pin 21 goes up the inclined surface 19B back into the recess 24A of the switching member 24. In this position, when the pushbutton 12 is pressed down again, the tip end of the pin 21 comes into engagement with the inclined surface 19A and is guided by the surface to the left until it abuts against the abutment surface 19AA. With continued depression of pushbutton 12, the movable contact support 19 begins to be turned in a counterclockwise direction. Upon the movable contact support 19 being slightly shifted from its horizontal position toward the left end lowered position, the movable contact support 19 is snappingly pivoted in a counterclockwise direction under the biasing force of the spring 23 to be inverted to its left end lowered position. The movable contact piece 18 thus comes into contact with the fixed contact 16 with the free end portions 18AE and 18BE pinching the fixed contact therebetween to thereby switch the common contact 15 into electric contact with the fixed contact 16.

Figure 4:
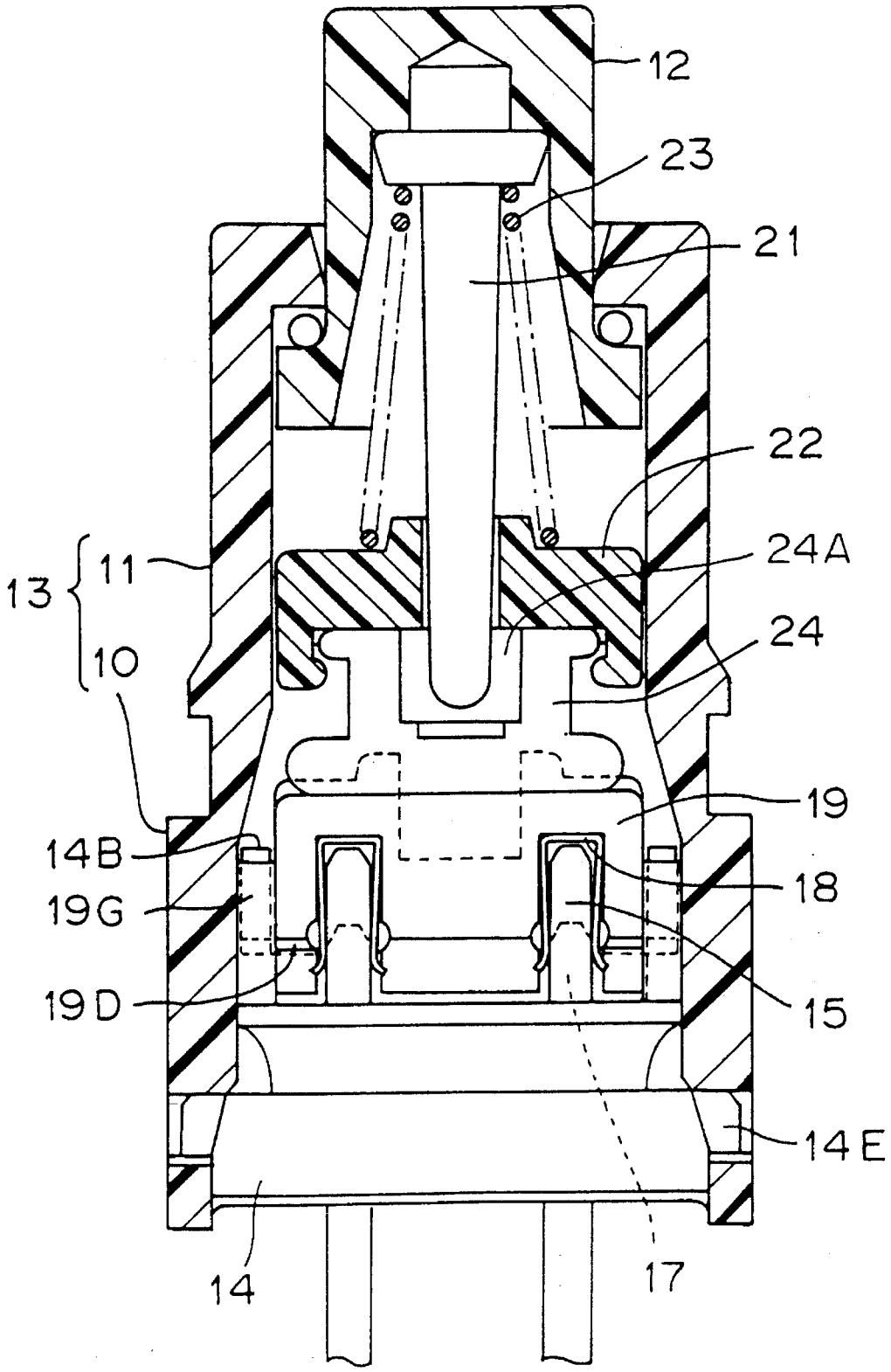
FIG. 4 is a vertical cross-sectional view taken on line IV—IV of FIG. 3 showing the pushbutton 12 being restored to its upper position.
Figure 11:
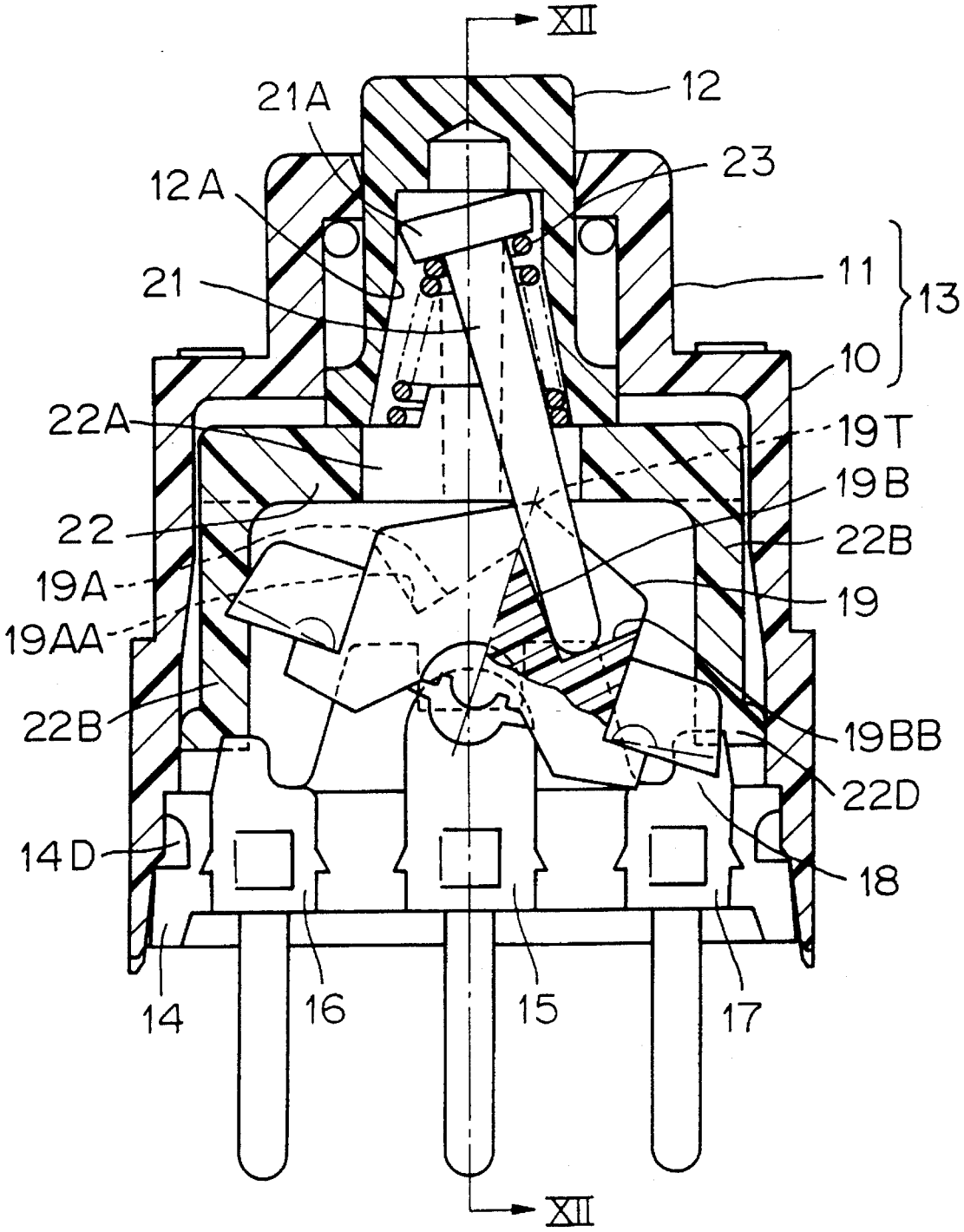
FIG. 11 is a vertical cross-sectional view of the pushbutton switch according to a second embodiment of this invention showing the pushbutton 12 being depressed.
Figure 12:
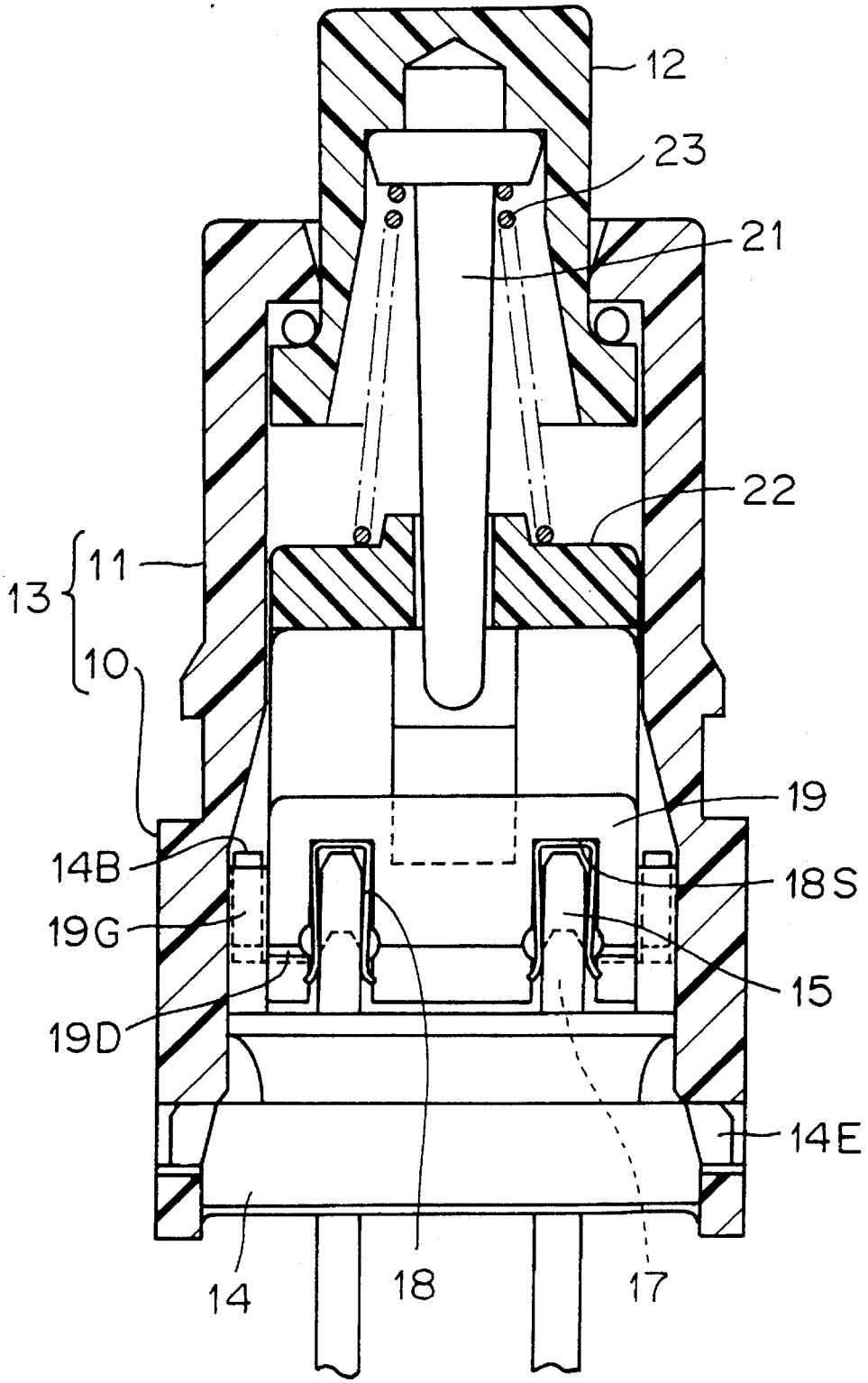
FIG. 12 is a vertical cross-sectional view taken on line XII—XII of FIG. 11 showing the pushbutton 12 being restored to its upper position.
Figure 13:
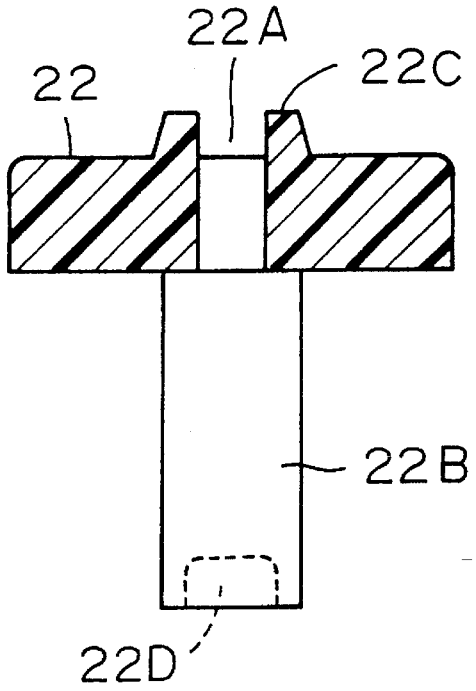
FIG. 13 is a cross-sectional view of the spring retainer plate 22 shown in FIG. 11.
Figure 14:
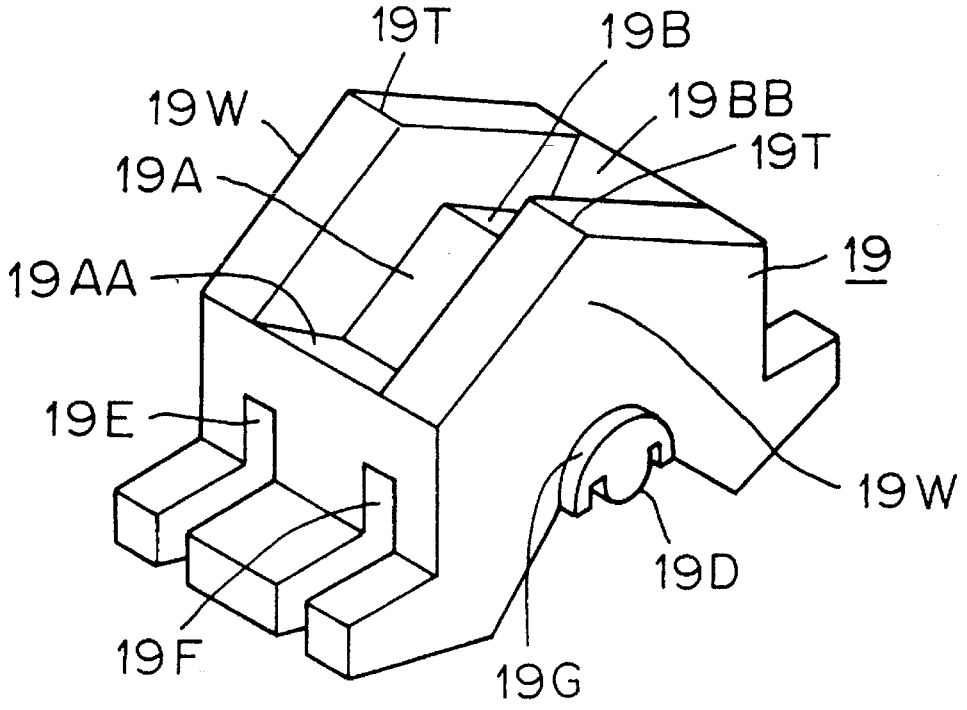
FIG. 14 is a perspective view of the movable contact support 19 in the embodiment of FIG. 11.

While in the first embodiment illustrated in FIGS. 3 and 4 the spring retainer plate 22 under the resilient force of the spring is arranged so as to impart s hold-down pressure through the swingable switching member 24 to the movable contact support 19 to maintain the latter in a stable state in both of the oppositely tilted positions, FIGS. 11 and 12 illustrate a second embodiment of the invention in which the switching member 24 is omitted so that the spring retainer plate 22 may impart a hold-down pressure directly to the movable contact support 19 to press it down in a "bistable" manner. The second embodiment is similar to the first embodiment except that the bottom surface of the spring retainer plate 22 and the top surface of the movable contact support 19 are modified so as to be slidable relative to each other. Accordingly, description of the construction common to the two embodiments and the operation thereof is omitted for purposes of convenience, and only the differences will be described in detail. In the second embodiment, as shown in a transverse cross-sectional view of FIG. 13, the bottom surface of the rectangular main plate portion of the spring retainer plate 22 is made flat by omitting therefrom the tabs 22F and protrusions 22G as shown in FIG. 6 for engagement with the switching member 24. In addition, as show in FIG. 14 corresponding to FIG. 8 for the first embodiment, the movable contact support 19 is free from the groove 19C as shown in FIG. 8 for engagement with the switching member 24, but instead is formed with slide crests 19T protruding from the top ends of the two opposed side walls 19W perpendicular to the pivotal axis of the movable contact support 19 between which extend the inclined surfaces 19A and 19B for guiding the tip of the pin 21. The central apices of the slide crests 19T define the highest point of the side walls 19W and are adapted to be in sliding contact with the undersurface of the spring retainer plate 22. The remainder of the movable contact support 19 is similar to that shown in FIG. 8. The undersurface of the spring retainer plate 22 is always maintained in sliding contact with the apices of the slide crests 19T as illustrated in FIG. 11.

Figure 15:
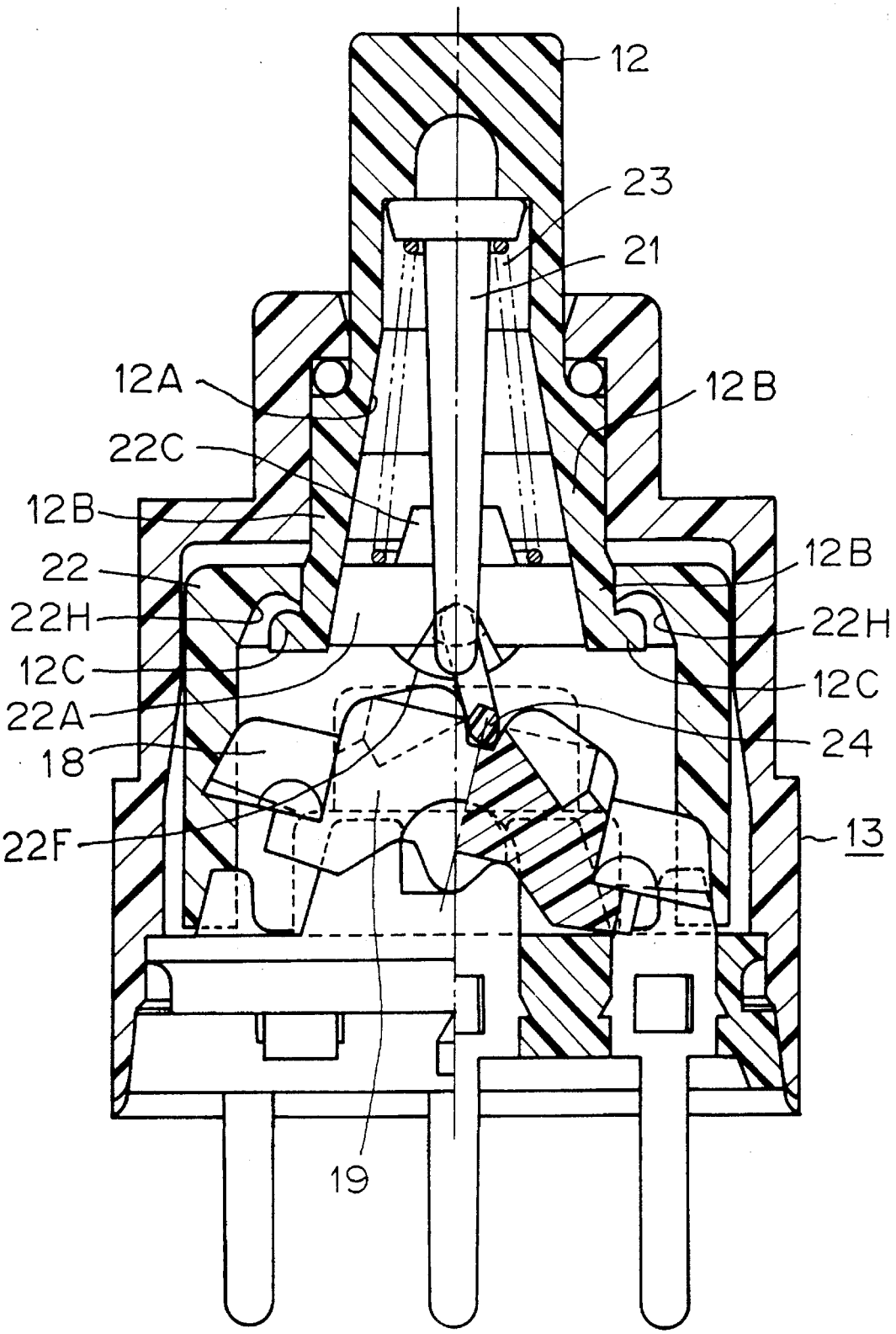
FIG. 15 is a vertical cross-sectional view of the pushbutton switch according to a third embodiment of this invention representing a modification of the embodiment of FIG. 3.

As the tilt of the movable contact support 19 is inverted by the pin 21, the apices of the slide crests 19T pass across the central line XII—XII while lifting the spring retainer plate 22, whereupon the apices of the slide crests 19T are subjected to a moment in the direction of the inverted movement of the contact support 19 by the downwardly directed resilient force of the spring 23 exerted on the slide crests 19T through the spring retainer plate 22 to complete the inversion of the movable contact support 19. The tip end of the pin 21 slides down the corresponding inclined surface of the movable contact support 19 until it abuts against the abutment surface to hold the contact support in its tilted position. FIG. 15 illustrates a third embodiment representing a modification of the embodiment of FIG. 3. In FIG. 15 corresponding components are indicated by like numerals. In this embodiment, the cylindrical pushbutton 12 shown in FIG. 3 is modified such that the cylindrical pushbutton 12 has a pair of diametrically opposed legs 12B integral with and extending downwardly from the lower end thereof in parallelism with the central axis of the pushbutton, each leg 12B being formed on its outer surface adjacent its lower end with a locking protrusion 12C, and the slot 22A in the spring retainer plate 22 is enlarged to be approximately equal to the diameter of the lower portion of the pushbutton 12 so that the pair of legs 12B of the pushbutton 12 are engageable with the slot 22A. The pair of legs 12B of the pushbutton 12 are insertable into the slot 22A by flexing toward each other, and upon being released after they are inserted, the looking protrusions 12C are resiliently engaged with the opposed walls of the slot 22A to prevent withdrawal of the pushbutton. In this embodiment, the spring retainer plate 22 is formed in its undersurface adjacent the opposite ends of the slot 22A with recesses 22H for lockingly receiving the protrusions 12C so that the legs 12B do not protrude excessively beyond the undersurface of the spring retainer plate 22.

According to this embodiment, the pin 21 and spring 23 are inserted into the pin receiving hole 12A of the pushbutton 12 which is inverted upside down. Then, the legs 12B of the pushbutton 12 while being flexed toward each other are inserted into and through the slot 22A of the spring retainer plate 22 against the resilient force of the spring 23 as the bosses 22C of the spring retainer plate 22 are engaged with the end of the spring 23 until the protrusions 12C of the legs 12B are brought into engagement with the recesses 22H of the spring retainer plate 22. This facilitates the handling of the various components during the assembly because the pushbutton 12, pin 21, spring 23, and spring retainer plate 22 having the switching member 24 in advance mounted thereto may be secured together as a first subassembly. This subassembly is then inserted into the insulating case 13.

On the other hand, the movable contact support 19 having the movable contact pieces 18 in advance mounted thereto is attached to the bottom panel 14 by resiliently fitting the movable contact pieces 18 over the common contact 15 and either the fixed contact 16 or 17. The bottom opening of the case 13 having the first subassembly inserted therein is then closed by the bottom panel preassembled as a second subassembly. In doing this, the 14. switching member 24 is in advance tilted in a direction corresponding to the tilt of the movable contact support 19 preset by the angle defined by the V-groove 22E.

In this embodiment it is thus to be understood that the assembling operation is significantly facilitated since the pushbutton 12, pin 21, spring 23, spring retainer plate 22, and switching member 24 need only be mounted into the case 13 as a preassembled subassembly. In this case, the legs 22B of the spring retainer plate 22 need not be formed with protuberances 22D as shown in FIGS. 3 and 5.

Figure 16:
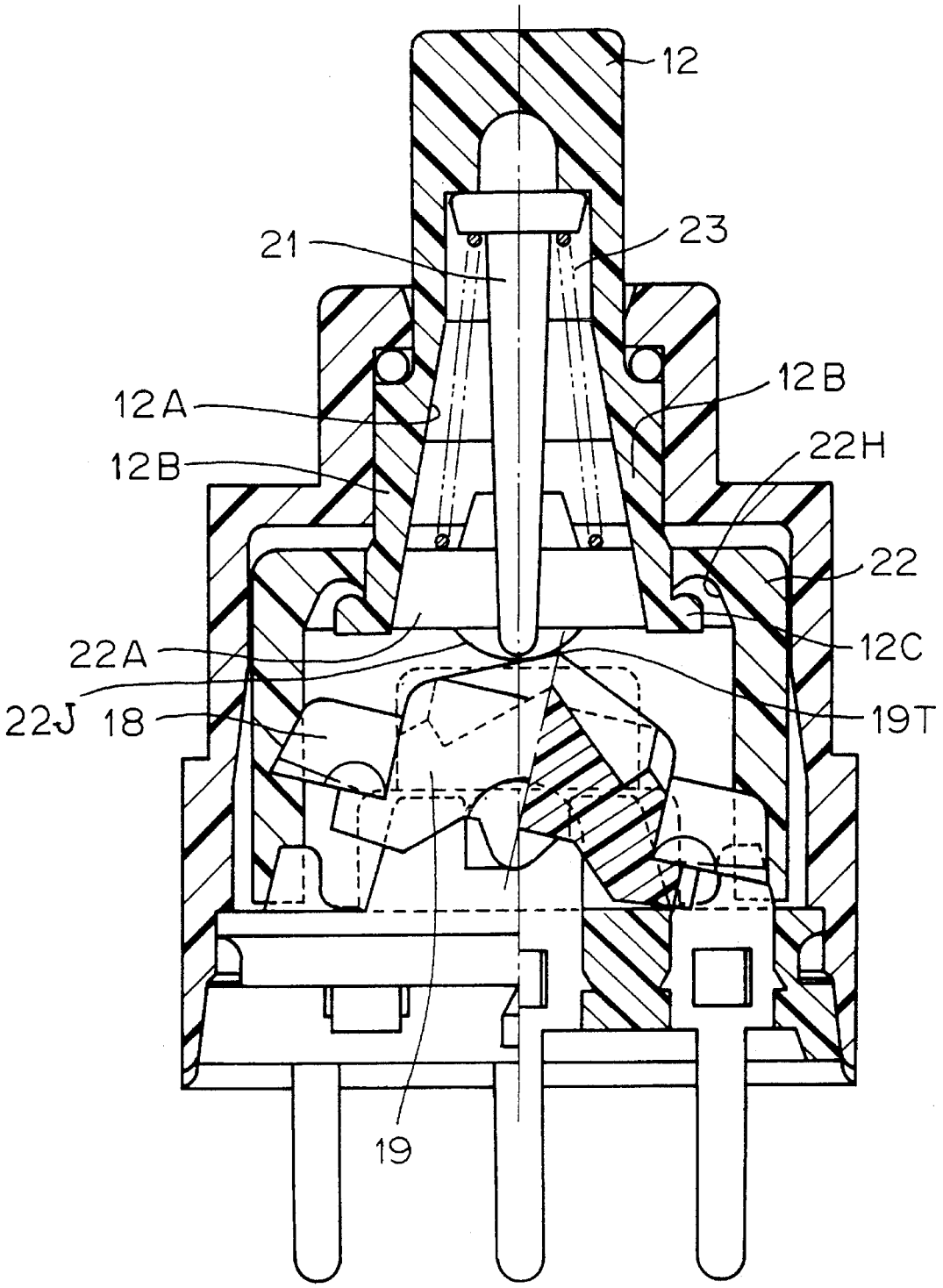
FIG. 16 is a vertical cross-sectional view of the pushbutton switch according to a fourth embodiment of this invention representing a modification of the embodiment of FIG. 11.

FIG. 16 shows a fourth embodiment in which the second embodiment of FIG. 11 is modified as in the embodiment of FIG. 15. In FIG. 16 corresponding components are indicated by like numerals. This embodiment is similar to that of FIG. 11 in that the movable contact support 19 is provided with slide crests 19T protruding from the top thereof so as to be slidable relative to the bottom surface of the spring retainer plate 22 whereby the movable contact support 19 may also act as a switching member. In the FIG. 16 embodiment, however, the undersurface of the spring retainer plate 22 is formed with a pair of arcuate tabs 22J at the opposite side edges thereof at the same location as the tabs 22F in the FIGS. 5 and 6 embodiment are located. The arcuate peripheral surfaces of the tabs 22J are adapted to slide relative to the two slide crests 19T of the movable contact support 19, so that the bistability of the movable contact support 19 is further enhanced. Moreover, as in the FIG. 15 embodiment, the pushbutton 12 has a pair of opposed legs 12B extending downwardly from the lower end thereof, each leg 12B being formed with a locking protrusion 12C, so that the pair of legs 12B are insertable into and through the slot 22A of the spring retainer plate 22 with the looking protrusions 12C interlocked with the recesses 22H in the opposed walls of the slot 22A.

The construction and operation of the rest of this embodiment are similar to those of the embodiments of FIGS. 11 and 15, and further description thereof is omitted. While the procedures of assembling this embodiment are similar to those for the FIG. 15 embodiment, the assembly is rendered even easier since a separate switching member is omitted.

While in the embodiments of FIGS. 15 and 16 the pair of legs 12B of the pushbutton 12 are arranged to be inserted into the slot 22A of the spring retainer plate 22, locking through-bores, not shown, separate from the slot 22A may be formed through the spring retainer plate 22 for receiving the legs 12B.

As discussed above, in the first and third embodiments of this invention, the spring retainer plate 22 is formed at its opposite ends with a pair of legs 22B depending therefrom so that the legs 22B may maintain the posture of the spring retainer plate 22 parallel to the bottom panel 14 while at the same time the movable contact support 19 may be held in a "bistable" manner by the switching member 24 subjected to the resilient force of the spring 23 through the undersurface of the spring retainer plate 22. Accordingly, the spring retainer plate 22 may be reproducibly assembled in the case 13 in a fixed position (parallel the bottom panel 14). As a result, the assembling operation is facilitated enough to be feasible for mass production.

The second and fourth embodiments in which the top of the movable contact support 19 is so configured as to have upwardly protruding extensions adapted to be in sliding contact with the undersurface of the spring retainer plate 22 whereby the movable contact support 19 may also act as a switching member may reduce the number of parts as well as facilitating the assembling operation.

In addition, as in the first and second embodiments, the legs 22B depending from the spring retainer plate 22 are formed at their lower ends with protuberances 22D which may be urged against the inner wall of the switch housing section 10 by utilizing the resilience of the legs 22B to thereby temporarily fix the position of the spring retainer plate 22. This construction makes it possible to temporarily secure the pushbutton 12, pin 21, compression spring 23 and spring retainer plate 22 as assembled together in the pushbutton housing section 11 and switch housing section 10. This introduces the additional advantage of further facilitating the assembly.

Alternatively, the advantage of further facilitating the assembly may be provided by having a pair of legs 12B extending downwardly from the lower end of the pushbutton 12 and arranging the legs 12B to be insertable into and engageable with the slot 22A of the spring retainer plate 22, as in the third and fourth embodiments.

What is claimed is:

1. A pushbutton switch comprising:

(a) an insulating case including a box-like switch housing section with a top and a bottom, and a pushbutton housing section integrally connected with the top of said switch housing section and cooperating with said switch housing section to define an interior space, said pushbutton section having a top opening and a bottom opening;

(b) a pushbutton slidably accommodated in said pushbutton housing section and having an upper portion which retractably extends from said top opening, said pushbutton having a lower end formed with a pin accommodating hole;

(c) a bottom panel closing the bottom opening of said insulating case and having a common contact extending therethrough and fixed thereto centrally of a lengthwise direction thereof, said bottom panel having first and second spaced apart fixed contacts extending therethrough and fixed thereto on opposite sides of the common contact, said first and second fixed contacts and said common contact being arranged in a lengthwise direction of the bottom panel;

(d) a movable contact piece pivotable about and in contact with said common contact protruding inwardly from said bottom panel;

(e) a movable contact support made of insulating material, said movable contact support fitting over and carrying said movable contact piece and being supported on said bottom panel for seesaw motions about a pivotal axis, said movable contact support having first and second oppositely inclined top surfaces converging toward each other to define a ridge, said first and second top surfaces each having lowermost ends, and third and fourth inclined top surfaces extending away from each other from the lowermost ends of said first and second inclined top surfaces, respectively, said third and fourth inclined top surfaces sloping oppositely from the first and second inclined top surfaces;

(f) a pin having a first end inserted in said pin accommodating hole formed in the lower end of said pushbutton and a second end adapted to oppose either one of said first and second inclined top surfaces, and upon said pushbutton being depressed, said second end of the pin sliding along either opposing one of the first and second inclined top surfaces until said second end abuts against the corresponding one of said third and fourth inclined top surfaces to effect said seesaw motions of the movable contact support thereby to switch engagement of said movable contact piece with said first and second fixed contacts;

(g) a spring retainer plate made of a plate member having a shape generally conforming to the shape in a plan view of the interior space of said switch housing section, said plate member being formed generally at a center thereof with a slot through which said pin is passed for pivotal movements in a direction longitudinal of the plate member, said plate member having a pair of legs extending from opposite ends of a length of the plate member along an inner wall of said switch housing section toward said bottom panel to allow slidable up-down movement of said retainer plate, said plate member having an undersurface in which a first groove is formed parallel to said pivotal axis;

(h) a coil spring surrounding said pin and having an upper end and a lower end, the upper end of the coil spring being inserted in said pin accommodating hole so as to urge the first end of said pin against an inner surface of the pin accommodating hole, the lower end of the coil spring being secured to a top surface of said spring retainer plate and thereby imparting a downwardly directed pressure to said spring retainer plate; and (i) switch means comprising a plate-like switching member having an upper end pivotally engaging the first groove in the undersurface of said plate member, and a lower end pivotally engaging a second groove formed in the upper surface of said movable contact support along said ridge defined by said first and second inclined top surfaces for holding said movable contact support in one of two bistable states, said switching member being formed at the center of its upper end with a recess through which the lowerr end of said pin is permitted to pass.

2. The pushbutton switch of claim 2 wherein, said spring retainer plate has a pair of opposed tabs depending from the undersurface thereof at opposite ends of said first groove, said tabs having opposed protrusions at their lower ends extending inwardly toward each other and parallel to the undersurface of said spring retainer plate, said switching member being formed adjacent upper portions of its opposed ends with protrusions extending outwardly away from each other to interlock with the corresponding protrusions of said spring retainer plate for pivotally supporting said switching member.

3. The pushbutton switch of claim 1 wherein, said switching means comprises a pair of opposed extensions integrally formed with and protruding upwardly from the upper surface of said movable contact support, said pair of extensions being separated from each other along the width of said switching means by said ridge defined by said first and second inclined surfaces and slidably engaging the undersurface of said spring retainer plate.

4. The pushbutton switch of claim 1 wherein, the pair of legs of said spring retainer plate are formed on outer surfaces adjacent lower ends thereof with lateral protuberances resiliently engaging the inner wall of said switch housing section.

5. The pushbutton switch of claim 1 wherein, said pushbutton has a pair of opposed legs formed integral with and extending downwardly from the lower end surface at opposite sides thereof, each leg having a locking protrusion adjacent its lower end, said legs being inserted in and engaged with locking recesses formed through the spring retainer plate.

6. A pushbutton switch comprising:

(a) an insulating case including a box-like switch housing section with a top and a bottom, and a pushbutton housing section integrally connected with the top of said switch housing section and cooperating with said switch housing section to define an interior space, said pushbutton housing section having a top opening and a bottom opening;

(b) a pushbutton slidably accommodated in said pushbutton housing section and having an upper portion which retractably extends from said top opening, said pushbutton having a lower end formed with a pin accommodating hole;

(c) a bottom panel closing the bottom opening of said insulating case and having a common contact extending therethrough and fixed thereto centrally of a lengthwise direction thereof, said bottom panel having first and second spaced apart fixed contacts extending therethrough and fixed thereto on opposite sides of the common contact, said first and second fixed contacts and said common contact being arranged in a lengthwise direction of the bottom panel;

(d) a movable contact piece pivotable about and in contact with said common contact protruding inwardly from said bottom panel;

(e) a movable contact support made of insulating material, said movable contact support fitting over and carrying said movable contact piece and being supported on said bottom panel for seesaw motions about a pivotal axis, said movable contact support having first and second oppositely inclined top surfaces converging toward each other to define a ridge, said first and second top surfaces each having lowermost ends, and third and fourth inclined top surfaces extending away from each other from the lowermost ends of said first and second inclined top surfaces, respectively, said third and fourth inclined top surfaces sloping oppositely from the first and second inclined top surfaces;

(f) a pin having a first end inserted in said pin accommodating hole formed in the lower end of said pushbutton and a second end adapted to oppose either one of said first and second inclined top surfaces, and upon said pushbutton being depressed, said second end of the pin sliding along either opposing one of the first and second inclined top surfaces until said second end abuts against the corresponding one of said third and fourth inclined top surfaces to effect said seesaw motions of the movable contact support thereby to switch engagement of said movable contact piece with said first and second fixed contacts;

(g) a spring retainer plate made of a plate member having an undersurface and a shape generally conforming to the shape in a plan view of the interior space of said switch housing section, said plate member being formed generally at a center thereof with a slot through which said pin is passed for pivotal movements in a direction longitudinal of the plate member, said plate member having a pair of legs extending from opposite ends of a length of the plate member along an inner wall of said switch housing section toward said bottom panel to allow slidable up-down movement of said retainer plate;

(h) a coil spring surrounding said pin and having an upper end and a lower end, the upper end of the coil spring being inserted in said pin accommodating hole so as to urge the first end of said pin against an inner surface of the pin accommodating hole, the lower end of the coil spring being secured to a top surface of said spring retainer plate and thereby imparting a downwardly directed pressure to said spring retainer plate; and (i) switch means comprising a pair of opposed extensions formed integrally with and protruding upwardly from the upper surface of said movable contact support, said pair of extensions being separated from each other in a widthwise direction of said movable contact support by said ridge, said pair of extensions slidably engaging the undersurface of said spring retainer plate for holding said movable contact support in one of two bistable states, the pair of legs of said plate member being provided, on outer surfaces adjacent lower ends thereof, with lateral protuberances which are in resilient engagement with the inner wall of said switch housing section.

7. The pushbutton switch of claim 6 wherein, the undersurface of said spring retainer plate is formed at a center thereof with arcuate tabs which are in sliding engagement with the extensions of said movable contact support.

8. A pushbutton switch comprising:

(a) an insulating case including a box-like switch housing section with a top and a bottom, and a pushbutton housing section integrally connected with the top of said switch housing section and cooperating with said switch housing section to define an interior space, said pushbutton housing section having a top opening and a bottom opening;

(b) a pushbutton slidably accommodated in said pushbutton housing section and having an upper portion which retractably extends from said top opening, said pushbutton having a lower end formed with a pin accommodating hole;

(c) a bottom panel closing the bottom opening of said insulating case and having a common contact extending therethrough and fixed thereto centrally of a lengthwise direction thereof, said bottom panel having first and second spaced apart fixed contacts extending therethrough and fixed thereto on opposite sides of the common contact, said first and second fixed contacts and said common contact being arranged in a lengthwise direction of the bottom panel;

(d) a movable contact piece pivotable about and in contact with said common contact protruding inwardly from said bottom panel;

(e) a movable contact support made of insulating material, said movable contact support fitting over and carrying said movable contact piece and being supported on said bottom panel for seesaw motions about a pivotal axis, said movable contact support having an upper surface including first and second oppositely inclined top surfaces converging toward each other to define a ridge, said first and second top surfaces each having lowermost ends, and third and fourth inclined top surfaces extending away from each other from the lowermost ends of said first and second inclined top surfaces, respectively, said third and fourth inclined top surfaces sloping oppositely from the first and second inclined top surfaces;

(f) a pin having a first end inserted in said pin accommodating hole formed in the lower end of said pushbutton and a second end adapted to oppose either one of said first and second inclined top surfaces, and upon said pushbutton being depressed, said second end of the pin sliding along either opposing one of the first and second inclined top surfaces until said second end abuts against the corresponding one of said third and fourth inclined top surfaces to effect seesaw motions of the movable contact support thereby to switch engagement of said movable contact piece with said first and second fixed contacts;

(g) a spring retainer plate made of a plate member having an undersurface and a shape generally conforming to the shape in a plan view of the interior space of said switch housing section, said plate member being formed generally at a center thereof with a slot through which said pin is passed for pivotal movements in a direction longitudinal of the plate member, said plate member having a pair of legs extending from opposite ends of a length of the plate member along an inner wall of said switch housing section toward said bottom panel to allow slidable up-down movement of said retainer plate, said plate member having an undersurface in which a first groove is formed parallel to said pivotal axis;

(h) a coil spring surrounding said pin and having an upper end and a lower end, the upper end of the coil spring being inserted in said pin accommodating hole so as to urge the first end of said pin against an inner surface of the pin accommodating hole, the lower end of the coil spring being secured to the top surface of said spring retainer plate and thereby imparting a downwardly directed pressure to said spring retainer plate; and (i) switch means comprising a pair of opposed extensions formed integrally with and protruding upwardly from the upper surface of said movable contact support, said pair of extensions being separated from each other in a widthwise direction of said movable contact support by said ridge, said pair of extensions slidably engaging the undersurface of said spring retainer plate for holding said movable contact support in one of two bistable states, said pushbutton having a pair of opposed legs extending downwardly at opposite sides thereof, each leg having a locking protrusion adjacent its lower end, said legs being inserted in and engaged with locking recesses formed in the spring retainer plate.

9. The pushbutton switch of claim 1, 6 or 8 wherein, said movable contact piece is made of resilient metal sheet and comprises a pair of spaced opposed elongated contact blades interconnected with each other intermediate opposite ends thereof, said contact blades having opposite end portions for resiliently pinching selectively either one of said first and second fixed contacts therebetween.

10. The pushbutton switch of claim 9 wherein, a central portion of said movable contact piece intermediate their opposite ends is mounted and held in a groove formed in an undersurface of said movable contact support.

11. The pushbutton switch of claim 1, 6 or 8 wherein, said bottom panel has a pair of bearing portions extending from opposed side edges at a center thereof, said movable contact support being supported on said bearing portions for seesaw motions, said common contact being supported by said bottom panel in juxtaposition with the bearing portions, a central portion of said movable contact piece being always in resilient contact with said common contact.

* * * * *